US006990753B2

(12) United States Patent
Fuerst

(10) Patent No.: US 6,990,753 B2
(45) Date of Patent: Jan. 31, 2006

(54) THREE POINT FOOTWEAR

(75) Inventor: Rory W. Fuerst, Atherton, CA (US)

(73) Assignee: Keen LLC, Alameda, CA (US)

( * ) Notice: Subject to any disclaimer, the term of this patent is extended or adjusted under 35 U.S.C. 154(b) by 0 days.

(21) Appl. No.: 10/936,880

(22) Filed: Sep. 8, 2004

(65) Prior Publication Data

US 2005/0274040 A1 Dec. 15, 2005

Related U.S. Application Data

(60) Provisional application No. 60/580,154, filed on Jun. 15, 2004.

(51) Int. Cl.
*A43B 3/12* (2006.01)

(52) U.S. Cl. ..... 36/11.5

(58) Field of Classification Search ..... 36/11.5, 36/94, 7.5, 7.6

See application file for complete search history.

(56) References Cited

U.S. PATENT DOCUMENTS

| | | | | |
|---|---|---|---|---|
| 1,386,684 | A | 8/1921 | Bradford | |
| 1,894,561 | A * | 1/1933 | Guiffre | 36/11.5 |
| 2,193,943 | A * | 3/1940 | Shea | 36/11.5 |
| 2,239,206 | A * | 4/1941 | Tietig | 36/11.5 |
| 2,491,297 | A * | 12/1949 | Brown | 36/94 |
| 2,928,191 | A | 3/1960 | Meltzer | |
| D278,946 | S | 5/1985 | Chen | |
| 4,535,554 | A * | 8/1985 | De Obaldia B. | 36/113 |
| 6,243,974 | B1 * | 6/2001 | Schaj | 36/136 |
| D453,611 | S | 2/2002 | Birkenstock | |
| D486,297 | S | 2/2004 | Magro | |
| 6,883,252 | B2 * | 4/2005 | Cagner | 36/11.5 |

* cited by examiner

*Primary Examiner*—Ted Kavanaugh
(74) *Attorney, Agent, or Firm*—Foley & Lardner LLP

(57) ABSTRACT

Three point footwear articles having a sole itself having an integrally-molded toe protector with said toe protector affixed to the post point are disclosed.

17 Claims, 2 Drawing Sheets

THREE POINT FOOTWEAR

CROSS-REFERENCE TO RELATED PATENT APPLICATIONS

This application is claiming the benefit under 35 USC 119(e) U.S. Application 60/580,154, filed Jun. 15, 2004, incorporated herein by reference in its entirety.

FIELD OF THE INVENTION

This invention relates to footwear and in particular to improvements to footwear having a post that fits between the wearer's toes. Such footwear is often referred to as "three point" sandals, as "thong" sandals or as "flip flops".

BACKGROUND MATERIAL

Footwear having a post or strap that fits between the wearer's toes and which contributes to the engagement between the wearer's foot and the footwear article has been known literally for ages. One especially popular embodiment includes a pair of straps fastened to the post, arching back over the wearer's instep and terminating at the sole of the article midway between the ball of the foot and the heel. The three points of attachment—the post and the two straps gives rise to the "three point" identifier. Current culture at many levels values this design as simple, utilitarian and fashionable. Over the last fifty years, millions if not billions of pairs of simple beachwear "flip-flops" and other casual shoes and sandals have been marketed. While these footwear items of the art are often inexpensive, popular and stylish they are often marketed and purchased with the basic understanding that they are disposable and that they provide minimal structure and protection to any surfaces of the wearer's foot other than his or her soles. By this invention we provide three point footwear articles that are more structured and protective of their wearers' feet.

The following United States Patents relate to footwear of this general class: U.S. Pat. Nos. 2,928,191; 1,386,684; 2,193,943; 4,535,554; D278,946; D453,611; and D486,297.

STATEMENT OF THE INVENTION

It has now been found that three point footwear is improved by adding an integrally-molded toe cap to the sole and by joining this toe cap to the post with a fourth attachment point.

Thus, this invention in one embodiment provides an article of footwear for a wearer. This article includes a sole itself comprising an integrally-molded toe piece extending upwards from the sole's front end and extending backwards over at least a portion of at least two of the wearer's toes. The article additionally includes a post extending upwardly from the sole in a position so that it will fit between adjacent toes of the wearer. A first strap extends from the sole at a position medial to the wearer's arch. This strap extends forward and is connected to the post at a point above the wearer's toes. A second strap also extends from the sole but at a position proximal to the wearer's arch. This second strap extends forward and is also connected to the post at a point above the wearer's toes. There is a connector coupling the post to the integrally-molded toe piece.

In most cases this article of footwear is a sandal.

In an additional embodiment, the sole of the article of footwear itself is a multi-piece molded sole, typically with an insole, midsole and outsole. While somewhat more complicated than the soles commonly seen in "flip flops" and the like, this multi-piece molded sole adds a significant amount of additional structure to the article of footwear and provides a significantly more stable and upscale product. In this embodiment an article of footwear for a wearer is provided. This article includes a sole itself made up of a ground-contacting molded outsole layer, a molded midsole layer and a wearer's-foot-supporting molded insole layer. The sole extends from a front end adjacent to the tip of the wearer's toes, under the wearer's arch and to a rear end which terminates at the wearer's heel. The midsole layer is located intermediate the outsole layer and the insole layer and is bonded to one or both of these layers. One of the three layers of the sole (most commonly either the midsole or the outsole) including an integrally-molded toe piece extending upwards from the front end and extending backwards over at least a portion of at least two of the wearer's toes. The article also includes a post extending upwardly from the insole. This post is positioned to fit between adjacent toes of the wearer. A first strap extends from between adjacent sole layers at a position medial to the wearer's arch and extends forward and is connected to the post at a point above the wearer's toes. A second strap also extends from between adjacent sole layers but at a position proximal to the wearer's arch and extends forward and is connected to the post at a point above the wearer's toes. There is a connector (commonly an extension of one of the two straps) which couples the post to the integrally-molded toe piece.

BRIEF DESCRIPTION OF THE DRAWINGS

This invention will be further described with reference being made to the attached drawings in which.

DESCRIPTION OF PREFERRED EMBODIMENTS

Turning now to the drawings, all seven figures relate to a single embodiment of the invention, sandal 10. This is merely a representative embodiment and it will be appreciated that it is not to be construed as defining the metes and bounds of this invention. Those are set by the appended claims.

Figure 1:
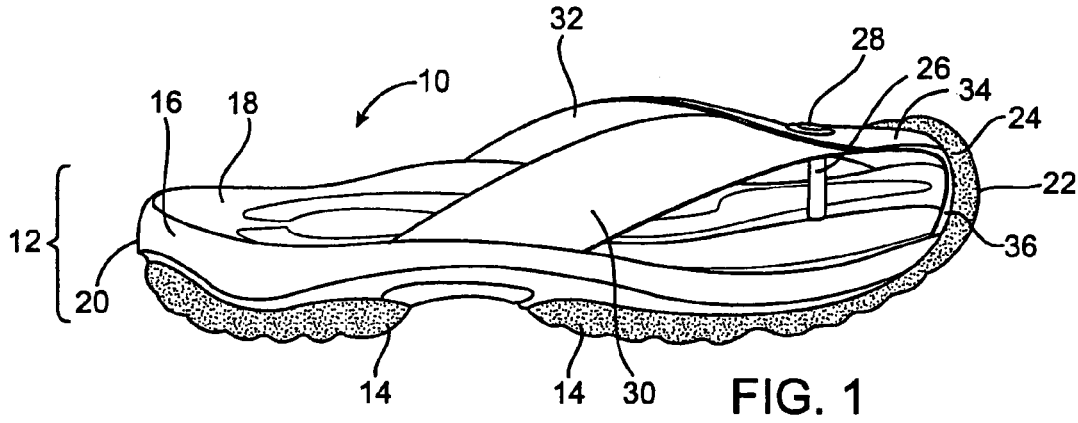
FIG. 1 is a perspective view of a an article of footwear (i.e. a sandal).
Figure 2:
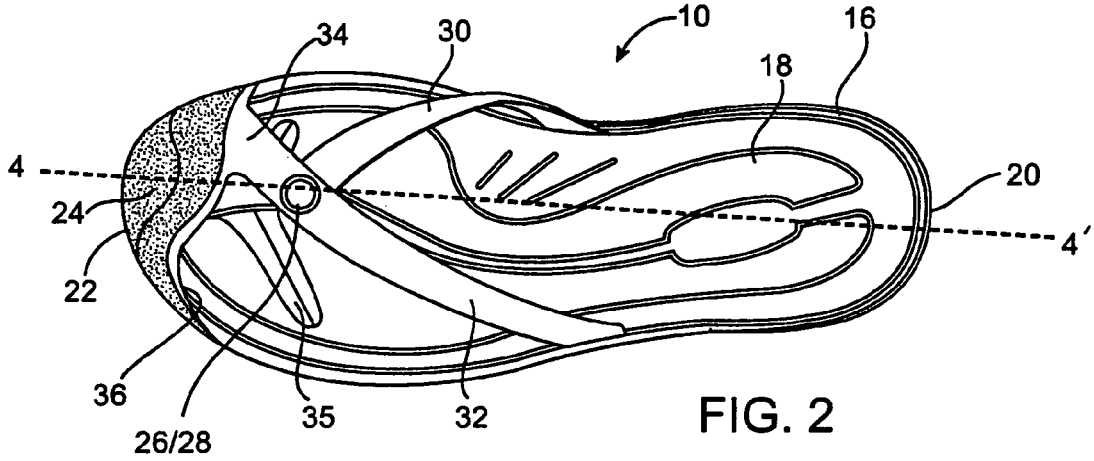
FIG. 2 is a top plan view of the sandal shown in FIG. 1
Figure 3:
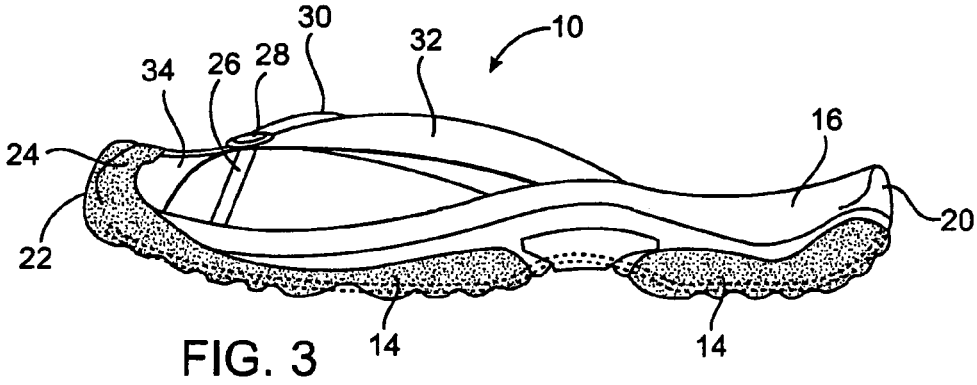
FIG. 3 is a side elevation view of the sandal shown in FIG. 1

Sandal 10, as illustrated in FIGS. 1, 2 and 3 includes a sole unit 12 made up of outsole 14, shown with stippling only for contrast to enable the contours of this sole segment to be distinguished from the midsole 16 and insole 18. Sole 12 extends from the rear of heel section 20 through a front-of-toe section 22. The toe section extends upwards and curves back upon itself to form a toe protection area 24. Area 24 covers and provides frontal protection to at least about two and preferably at least about three and more preferably at least about four of the wearer's toes. Area 24 is integrally molded into the sole 12. In the embodiment shown this overarching section is at least in part part of the outsole 14. It could also be a part of the midsole or a combination of these sole segments. The term "integrally-molded" connotes that the area 24 is molded as a unit with the respective sole segment and is not an added-on separate piece.

Sandal 10 includes a post 26. Post 26 extends upwards from sole 12 and is positioned in the forefoot area of the sandal, near front end 22. It is further positioned to fit between and engage a pair of adjacent toes of the wearer of the sandal 10. Most commonly the post is positioned to fit between the wearer's big toe and first toe adjacent thereto. When the wearer's foot is so engaged, the tips of the toes should fit comfortably behind the toe protection area 24. with the at least two, three or four toes being protected as described hereinabove.

Sandal 10 includes a pair of straps 30 and 32. These straps extend from the lateral (strap 32)1 and medial (strap 30) sides of the midfoot area of sole 12 at one end and meet at the top of post 26 where they are held in place by fastener 28. The two straps are sized to engage the wearer's foot when it is inserted such that the wearer's toes straddle post 26.

Sandal 10 additionally includes a connector 34 which connects the post 26 to the toe protection area 24. This can be a separate piece, or, as shown and as preferred, can be an extension of one of the two straps, 30 or 32. In the embodiment shown in FIGS. 1, 2 and 3, lateral strap 32 is shown extending past post 26 to also act as connector 34 which connects to the medial area of toe protector 24 in a smooth unitary arc. As will be described in more detail hereinafter, integrally-molded toe protector 24 is made of rubber or plastic. For comfort it is generally lined with fabric. This fabric lining can be an extension of the lining of the connector 34 and straps 30 and 32, if desired. The outer edge 36 of this lining can be congruent with the edge of protector 24 or, as shown in FIGS. 1 and 2 can extend beyond the edge of the protector, somewhat for comfort.

Figure 4:
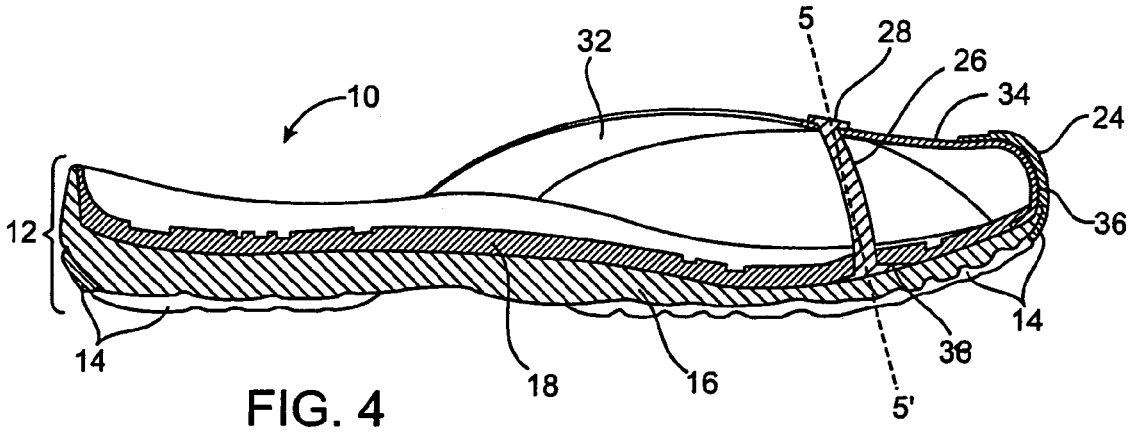
FIG. 4 is a cross sectional side view of the sandal of FIG. 1 taken along line 4-4' which is the heel to toe axis of the sandal.

FIGS. 4 through 7 show details of construction of embodiment 10 of this invention. FIG. 4 shows that sole 12 is constructed with an outsole 14, midsole 16 and insole 18. All of these parts are molded and engage one another. It will be appreciated that one could achieve the same toe protection advantages with a simpler construction, for example one in which the midsole and outsole were combined into a single unit or one in which the insole and midsole were combined. The more complicated construction shown in FIG. 4 does have its advantages as it permits a more structured, more supportive footwear article to be constructed.

Post 26 extends upwardly from the top of insole 18. In the embodiment shown and as emphasized in FIGS. 5 and 7, post 26 can have a flared section or "wings" 38 on its end distal from connector 28. During construction, post 26 can be threaded through a hole in the insole and the wings can be gripped between the insole 18 and midsole 16. The post can be fused or cemented into place, if desired.

Figure 6:
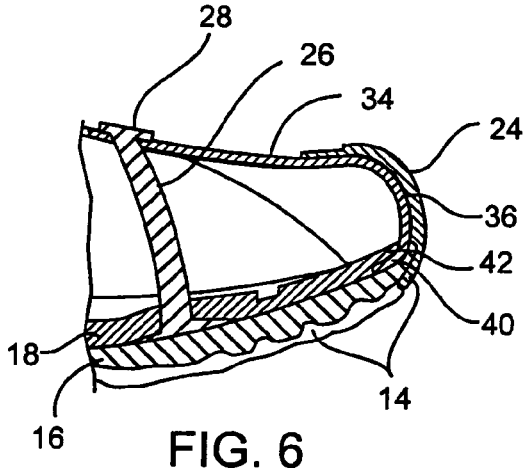
FIG. 6 is an expanded cross sectional view of the toe area of the sandal shown in FIG. 1 depicting a preferred construction.
Figure 5:
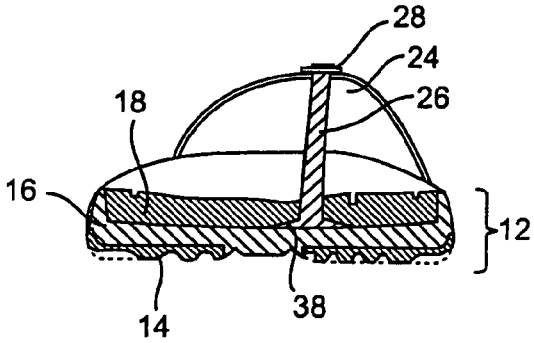
FIG. 5 is a cross sectional rear view of the sandal of FIG. 1 taken along line 5-5'.
Figure 7:
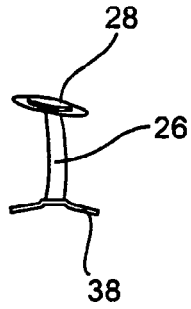
FIG. 7 is a side elevation view of a post employed in the footwear articles of this invention.

FIGS. 4 and 6 provide details of the relationship of the connector 34 to the toe protector 24. These Figures show an embodiment in which the toe protector 24 is an integral part of molded outsole 24. Connector 34 which runs from post 26 to protector 24 can extend as 36 down to the insole 18, as shown in FIG. 4. Preferably, as shown in FIG. 6 connector 34 extends as lining 36 to beneath insole 18 and the end 40 of lining 36 fits under the tip 42 of insole 18 and is laminated into place between the midsole 16 and the insole 18. This provides a comfortable environment for the wearer's toes and also adds strength and durability to the toe protector 24.

The soles of these footwear articles are generally molded of plastics and rubber, both synthetic and natural. The straps are either molded plastic or rubber or, and this is preferred are fabric or at least fabric lined.

The materials employed in the present footwear are all relatively conventional. The midsole and insole are made from a rubber or plastic material that is typically foamed for light weight. In many cases these two sole sections are made of the same foamed rubber or plastic but it is also possible to use different materials for each end so as to vary their properties and thus to achieve better stability, better cushioning or the like. Representative midsole and insole materials are foamed urethanes or foamed EVAs such as phylon or the like. The molded pieces of the insole and midsole can be joined together with an adhesive such as a cyanoacrylate adhesive or a urethane adhesive or a bonding solvent or the like. Heat and pressure can be applied to assist in the bonding and joining process.

The outsole is formed of a rubber or plastic material that is commonly chosen for its combination of flexibility and durability. Rubbers, including both natural and synthetic rubbers, can be used as can plastics such as urethanes and higher density EVA materials.

The integrally-molded toe protection area is formed from the same material as the sole section with which it is integrally molded.

The post is typically made of a flexible structural plastic.

The straps are typically formed of a durable natural or synthetic fabric or of plastic or rubber as desired.

While this invention has been described in terms of this preferred embodiment 10 it will be recognized by those of skill in the art that this invention can be employed in all manner of "three point" or "thong" footwear.

What is claimed is:

1. An article of footwear for a wearer comprising a sole extending from a front end adjacent to the tip of the wearer's toes, under the wearer's arch and to a rear end adjacent to the wearer's heel and including an integrally-molded toe piece extending upwards from the front end and extending backwards over at least a portion of at least two of the wearer's toes, a post extending upwardly from the sole and positioned to fit between adjacent toes of the wearer, a first strap extending from the sole at a position medial to the wearer's arch and extending forward and connected to the post at a point above the wearer's toes, a second strap also extending from the sole but at a position proximal to the wearer's arch and extending forward and connected to the post at a point above the wearer's toes and with a connector coupling the post to the integrally-molded toe piece. claim 1.

2. The article of footwear of claim 1 wherein the connector is an extension of the second strap.

3. The article of footwear of claim 1 wherein the first and second straps extend from between a midsole and an insole.

4. The article of footwear of claim 1 wherein the article is a sandal.

5. The article of footwear of claim 1 wherein the sole defines the shape of the article.

6. An article of footwear for a wearer comprising a sole itself comprising a ground-contacting molded outsole layer, a molded midsole layer and a wearer's-foot-supporting molded insole layer, the sole extending from a front end under the tip of the wearer's toes, under the wearer's arch and to a rear end under the wearer's heel, the midsole layer intermediate the outsole layer and the insole layer and bonded thereto, with a layer of the sole including an integrally-molded toe piece extending upwards from the front end and extending backwards over at least a portion of at least two of the wearer's toes, a post extending upwardly from the sole and positioned to fit between adjacent toes of the wearer, a first strap extending from between adjacent sole layers at a position medial to the wearer's arch and extending forward and connected to the post at a point above the wearer's toes, a second strap also extending from between adjacent sole layers but at a position proximal to the wearer's arch and extending forward and connected to the post at a point above the wearer's toes and with a connector coupling the post to the integrally-molded toe piece.

7. The article of footwear of claim 6 wherein the integrally-molded toe piece is integrally molded to the outsole layer.

8. The article of footwear of claim 6 wherein the integrally-molded toe piece is integrally molded to the midsole layer.

9. The article of footwear of claim 6 wherein the connector is an extension of the first strap.

10. The article of footwear of claim 6 wherein the connector is an extension of the second strap.

11. The article of footwear of claim 6 wherein the first and second straps extend from between the midsole and the insole.

12. The article of footwear of claim 6. wherein the molded insole and the molded midsole each comprise molded polyethylene-vinyl acetate.

13. The article of footwear of claim 12 wherein the outsole comprises blown rubber.

14. The article of footwear of claim 6 wherein the article is a sandal.

15. The article of footwear of claim 6 wherein the midsole defines the shape of the article.

16. The article of footwear of claim 6 wherein the midsole and the insole together define the shape of the article.

17. The article of footwear of claim 6 wherein the post extends upward through the insole layer.

* * * * *